United States Patent [19]

Weirich et al.

[11] 4,391,181

[45] Jul. 5, 1983

[54] HYDRAULIC CONTROL SYSTEMS FOR MINING APPARATUS

[75] Inventors: Walter Weirich, Dortmund; Michael Dettmers, Kamen; Kunibert Becker, Werl; Harry Rosenberg, Lüdinghausen, all of Fed. Rep. of Germany

[73] Assignee: Gewerkschaft Eisenhutte Westfalia, Lunen, Fed. Rep. of Germany

[21] Appl. No.: 207,507

[22] Filed: Nov. 17, 1980

Related U.S. Application Data

[63] Continuation of Ser. No. 948,458, Oct. 4, 1978, abandoned.

[30] Foreign Application Priority Data

Nov. 4, 1977 [DE] Fed. Rep. of Germany ..... 2749312

[51] Int. Cl.[3] ..... F15B 13/04

[52] U.S. Cl. ..... 91/29; 91/518; 251/31

[58] Field of Search ..... 91/6, 28, 29, 170 MP, 91/517, 518, 433; 251/31

[56] References Cited

U.S. PATENT DOCUMENTS

| | | | |
|---|---|---|---|
| 3,635,020 | 1/1972 | Mahlmann | 91/6 |
| 3,638,531 | 2/1972 | Rieschel | 91/170 MP |
| 3,776,098 | 12/1973 | Behrens | 91/29 |
| 3,814,375 | 6/1974 | Grottoh | 251/31 |
| 4,276,810 | 7/1981 | Zeuner | 91/461 |

FOREIGN PATENT DOCUMENTS

| | | | |
|---|---|---|---|
| 1095112 | 12/1967 | United Kingdom | 91/170 MP |

*Primary Examiner*—Abraham Hershkovitz
*Attorney, Agent, or Firm*—Sughrue, Mion, Zinn, Macpeak & Seas

[57] ABSTRACT

A hydraulic control system, particularly for controlling the operation of roof support props of a mine working, employs control devices operated manually to feed pressure fluid to the working chambers of the props to effect extension or retraction thereof. A two-state valve device is operated when the props are extended to ensure that the correct setting pressure is established. This valve device has a control piston which is actuated to cause the device to establish independent connection between the main fluid pressure line and the associated working chambers of the props charged with fluid by the initial operation of the control devices. The connection established by the valve device is maintained even if the control devices break connection between the chambers and the pressure line. When the correct setting pressure is reached, a further control piston of the valve device is actuated to break the connection established by the valve device ready for the next operative cycle.

4 Claims, 2 Drawing Figures

HYDRAULIC CONTROL SYSTEMS FOR MINING APPARATUS

This is a continuation of application Ser. No. 948,458, filed Oct. 4, 1978, now abandoned.

BACKGROUND TO THE INVENTION

The present invention relates to hydraulic control systems for controlling the operation of fluid-operated units, particularly but not solely, support props of mine workings.

Mining apparatus employing roof supports of various kinds usually have control valves or devices used to connect pressure fluid feed and return lines to the props and supporting rams. Such control devices are usually manually-operated although some apparatus does utilize remote control. When the support props are extended to cause the roof engaging caps or the like carried thereby to contact the roof, it is vitally important to ensure the props are correctly set with the maximum pressure bearing on the roof before subsequent operations are carried out. This is, however, not always achieved. Visual inspection of the props cannot assist in this regard, since although the roof caps may contact the roof, this is not necessarily indicative that the lower working chambers of the props have reached the desired setting pressure. Consequently, there is a danger that the control devices may break connection between the fluid supply and the props prematurely before the correct setting pressure is reached.

A general object of the present invention is to provide an improved control system which will overcome this problem.

SUMMARY OF THE INVENTION

The present invention seeks to provide additional automatic pressure supply means which can reliably supplement deficient setting pressure created in the prop or props of a mine support.

A hydraulic control system has at least one manually-operable control device which selectively connects main pressure fluid feed and return lines to the working chambers of a hydraulically operated unit or prop in a manner known per se. In accordance with the invention, the system has means connected to the pressure fluid feed line and serving to selectively connect said line to one of the working chambers of the unit when the controlling device has been operated to likewise connect the pressure line to said one working chamber and to maintain such connection independent of the subsequent operation of said control device and means sensitive to the pressure prevailing in said one chamber and serving to effect disconnection of the pressure line when the pressure in said one chamber reaches a predetermined level.

The connection means thus by-passes the control device so that if this is prematurely operated to cut off the pressure line to the unit or prop the connection means will ensure the correct setting pressure is reached, thus avoiding the danger discussed previously. The connection means, which may take the form of a two-state valve device, may be used with a plurality of units or props and a plurality of associated control devices.

The connection means may be actuated by further pressure sensing means to establish the aforesaid connection when a pre-determined pressure threshold level is established in the chamber of the unit or prop. This actuation can then take place after the control device has been operated to connect the pressure line to the chamber so that the threshold level is greater than the pressure needed to extend the prop, or otherwise operate the unit in an analogous situation, but less than the correct setting level at which the connection means breaks off the by-pass connection. Where the connection means is a two-state valve device, the respective sensing means actuating the device at the threshold and setting pressure levels can be in the form of servo-control pistons of the device exposed to pressure fluid and opposing one another.

A further two-state valve device can be used to apply pressure fluid to the particular control piston causing the first-mentioned valve device to adopt a state establishing the by-pass connection. This further valve device can be operated directly by the associated control device or indirectly by utilizing its own control piston which actuates the further valve device at the threshold pressure level which thereby in turn applies fluid to the associated control piston of the first-mentioned valve device. It is desirable to provide a pressure-relief valve to exhaust fluid from the control piston of the first-mentioned valve device when the other control piston (actuable at the setting pressure) prevails. This pressure-relief valve can be conveniently used to adjust the setting pressure.

The first-mentioned valve device can be biased by spring force into a first state where the by-pass connection is broken. Similarly, the further valve device can be biased by spring force into a first state where a fluid connection to the control piston of the first valve device opposing the spring force to establish the by-pass connection is also broken. The fluid connection to this control piston of the first valve device can then be established by the further valve device tripping to a second state, thereby causing the first valve to trip to its second state.

A preferred embodiment of a control system constructed in accordance with the invention comprises:

(a) main pressure fluid feed and return lines;

(b) manually operable control devices for selectively connecting the feed and return lines to working chambers of props to effect extension and retraction thereof;

(c) a valve device connected to first working chambers of the props which are charged with fluid to effect extension of the props and to the pressure line, said valve device being settable to a first state, where connection is established between said working chambers and the pressure line or a second state, where connection is broken between the pressure line and said working chambers;

(d) a first control piston of the valve device for causing the valve device to adopt said first state when exposed to pressure fluid;

(e) means for exposing the first control piston to pressure fluid in dependence on the operation of at least one of the control devices to establish connection between the pressure line and said first working chamber of the, or each, associated prop; and (f) a further control piston of the valve device connected to one or more of said first working chambers to cause the valve device to adopt the second state subsequent to the adoption of the first state by the action of the first control piston and when a pre-determined setting pressure has been established in said one or more first working chambers.

The invention may be understood more readily and various other aspects and features of the invention may become apparent from consideration of the following description:

BRIEF DESCRIPTION OF DRAWINGS

An embodiment of the invention will now be described, by way of example only, with reference to the accompanying drawings, wherein.

DESCRIPTION OF PREFERRED EMBODIMENTS

Figure 1:
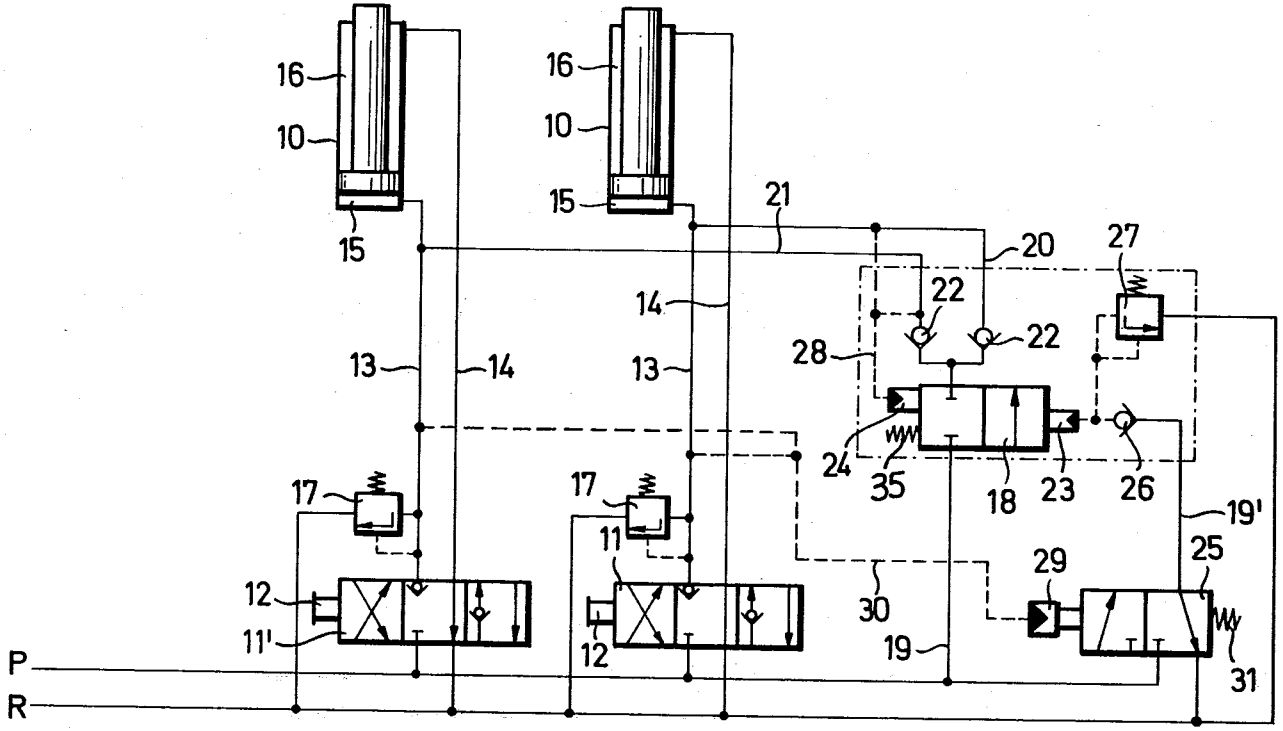
FIG. 1 is a block schematic diagram depicting a hydraulic control system constructed in accordance with the invention.

FIG. 1 depicts a hydraulic control system used, for example, to control fluid-operated units in the form of telescopic props 10 in a mine working. Each prop 10 can be extended and retracted separately or together by means of manually-operable control valve devices 11,11'. Instead of controlling one prop 10, each device 11,11' can control a set of props. The prop 10, or set of props, controlled by the device 11, may be at the mineral face end of a chock or support frame, while the prop 10, or set of props, controlled by the device 11', may be at the opposite goaf or stowage end of the chock or frame. Usually, the props 10 would carry roof-engaging members, such as caps or bars.

The control devices 11,11' may be combined in a constructional unit mounted on an accessible surface of the mine apparatus and operated manually by means of one or more levers operating on actuating elements 12 of the devices 11,11'.

Each device 11,11' has ports connected respectively to a hydraulic fluid pressure feed line P and to a hydraulic fluid return line R. Each device 11,11' has further ports connected via lines 13,14 respectively, to the respective working chambers 15, 16 of the associated prop 10 or set of props. Each device 11,11' can adopt one of three operating states depicted schematically in FIG. 1 and the operating states are altered by actuating the element 12 of the device 11,11'.

Thus, in a first neutral operating state represented in FIG. 1, each device 11,11' connects the line 14 to the return line R, while the line 13 is blocked. Pressure relief valves 17 are connected between the lines 13 and the return line R to relieve the working chambers 15 in the event of excessive pressure. In a second operating state, shown to the left-hand side of FIG. 1, each device 11,11' connects the line 13 to the return line R and the line 14 to the pressure line P. In a third operating state, shown to the right-hand side of FIG. 1, each device 11,11' connects the line 13 to the pressure line P and the line 14 to the return line R. In a known manner, one or more non-return valves can be incorporated in the devices 11,11'.

As can be appreciated, by actuating the devices 11,11' to adopt the third state, the chambers 15 of the props 10 can be charged with pressure fluid and the chambers 16 are exhausted to extend the props 10. Once the props 10 are properly set, the first state can be adopted to maintain the setting pressure. To retract the props 10, the devices 11,11' are changed to the second state to charge the chambers 16 and exhaust the chambers 15.

The control system of FIG. 1 employs an automatic setting arrangement, as will now be described.

As shown, a valve device 18 has a port connected via a line 19 to the pressure line P and a further port connected via lines 20,21 to the respective chambers 15 of the props 10. Non-return valves 22 are provided in the lines 20,21. The device 18 can adopt either of two operating states depicted schematically in FIG. 1. FIG. 1 depicts the device 18 in its first state, where the line 19 is isolated from the lines 20,21. In the second state, shown to the right-hand side of FIG. 1, the line 19, and hence the pressure line P, is connected to the lines 20,21. The device 18 is constructed as a servo valve and employs control elements or pistons 24, 23, which operate to change the state of the device 18. A spring 35 opposes the action of the piston 23. A further valve device 25 has ports connected to the pressure and return lines P,R and a further port connected via a line 19' and a non-return valve 26 to the piston 23. A pressure-relief valve 27 is connected in parallel with the non-return valve 26. The valve device 25 is also a two-state device 25. In the first state depicted in FIG. 1, the line 19' is connected to the return line R, whilst in the second state, shown to the left-hand side of FIG. 1, the line 19' is connected to the pressure line P. The device 25 also has a control element or piston 29, which is opposed by the force of a spring 31 biasing the device to the first state. Sufficient pressure on the piston 29 will change the state of the device 25. The control piston 29 of the device 25 is connected via a control line 30 to one of the lines 13 leading to one of the prop working chambers 15; although the line 30 can connect with both lines 13. The control piston 24 of the device 18 is similarly connected to the line 21 and thence to the line 13 leading to the other of the working chambers 15. It is, however, possible to connect the piston 24 with both lines 20,21.

The valve devices 25,18 effectively sense the prevailing pressure in the chambers 15 and automatically ensure the desired setting pressure is reached to avoid the dangers discussed above. The operation of the control system is as follows.

Assume that, as shown in FIG. 1, the props 10 have been retracted. In order to extend and set the props 10, the devices 11,11' are manually operated to adopt their third state, whereby the chambers 15 are charged with fluid and the chambers 16 are exhausted. During the time when the roof engaging members carried by the props 10 are being raised and have not contacted the roof, the pressure in the chambers 15 is only opposed by the weight of the extending upper parts of the props 10 and by frictional forces and is normally about 50 bars or less. When the roof-engaging members contact the roof, however, the pressure in the chambers 15 rises and eventually should reach a desired setting pressure equal to the pressure of the line P, or close to this pressure. Normally, the setting pressure would be at least 300 bars. If the devices 11,11' are actuated prematurely to the neutral first state, however, the props 10 will not be set properly, since the pressure in the chambers 15 will be lower than the desired setting pressure. The automatic setting arrangement (18,25) as described will prevent this problem from occurring. The control piston 29 is designed to actuate the device 25 to the second state when the pressure in the line 30 reaches a pre-determined threshold level, generally between 50 and 150 bars. Once the device 25 is actuated to its second state, against the restoring force of the spring 31, the line 19' conveys pressure fluid to the piston 23 via the non-return valve 26 and the device 18 charges to its second state to connect the chambers 15 to the pressure line P, thus by-passing the lines 13. In this way, the desired setting pressure can build up in the chambers 15, even if the devices 11,11' cut off the chambers 15 from the pressure line. The control piston 24 subsequently actuates the device 18 once the desired setting pressure is established to thereby change the device 18 back to its first state. As the piston 24 prevails over the piston 23 to change the device 18 to its first state, the pressure fluid in the associated cylinder containing the piston 23 is exhausted via the relief valve 27 as this fluid is prevented from passing back to the line 19' by the presence of the non-return valve 26. The exhausted fluid can flow back to the return line R, either through a direct connection as shown or via the device 25. The pressure at which the valve 27 is set to operate is preferably adjustable. By altering the pressure-setting, the piston 24 can be made to operate the device 18 at some desired prop setting pressure.

When the props 10 are subsequently retracted, and hence the chambers 15 are exhausted, the spring 31 will change the device 25 back to its first state to exhaust the piston 23 and the spring force will maintain the device 18 in its first state.

Since the automatic setting arrangement (18,25) only comes into operation when a pre-determined threshold pressure prevails in the chambers 15, it is possible to retract and partially extend the props 10 with the devices 11,11' with the arrangement non-operative. This is useful for certain operations.

Figure 2:
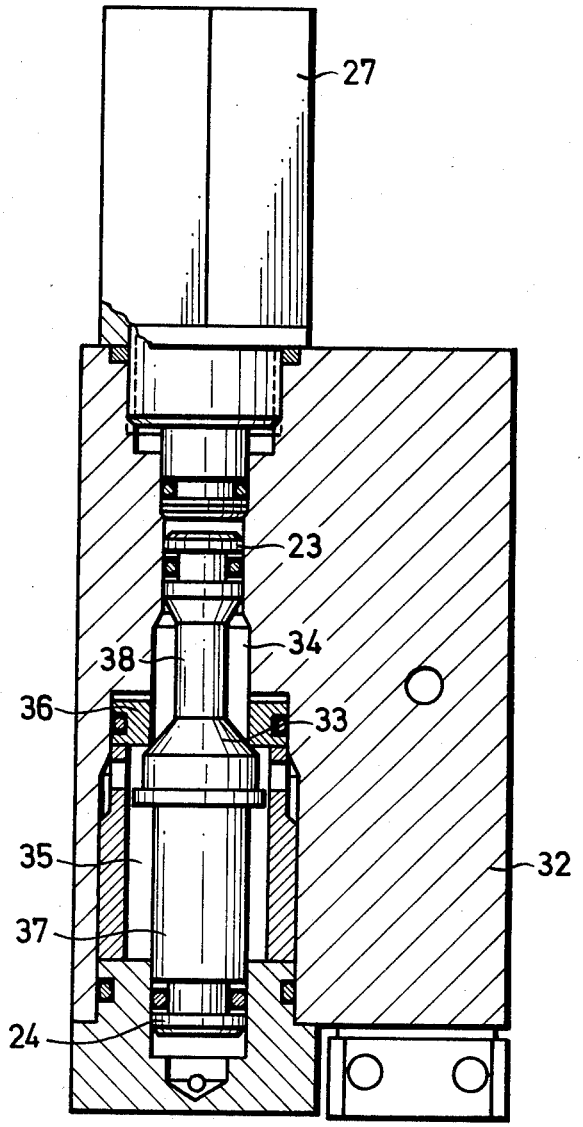
FIG. 2 is a sectional side view of a unit for use in the control system depicted in FIG. 1.

In a practical construction, the components of the system shown within the chain-dotted lines in FIG. 1 are combined as one constructional unit, shown in FIG. 2. As shown, this unit is composed of a unitary block 32 containing bores which accommodate the various valves and devices and convey the pressure fluid. The valve device 18 is here embodied as a valve element 33 of frusto-conical form slidable in a stepped bore 34 in the block 32. The element 33 is exposed to the force of the spring 35, which urges the sealing surface of the element 33 against a seating 36. The valve element 33 is integral with rods 37, 38. The rod 37 is formed with the control piston 24 at the end remote from the element 33. Similarly, the rod 38 is formed with the control piston 23 at its end remote from the valve element 33. The pressure relief valve 27 is engaged within a screw-threaded recess coaxial with the bore 24. The main parts of the device 18 are connected to the valve constituted by the seating 36 and the valve element 33. The valve can be opened or closed depending on the pressure on the pistons 23, 24, the force of the spring 35 and the action of the valve 27 in the manner described previously.

In a modification of the control system described above, the valve device 25 is coupled to the devices 11,11' so that the device 25 is set to its second state to initiate the automatic setting process when the devices 11,11' adopt their third state. In this case, the control line 30 is unnecessary, as is the pre-adjustment or design of the device 25 to actuate at a pre-determined pressure.

The control systems described can be employed with a variety of different types of mine roof supports employing props. In addition, the system can be employed with other forms of hydraulic equipment, for example, hydraulic anchoring or tensioning apparatus.

We claim:

1. In a hydraulic control system for controlling the operation of pressure-fluid operated support props of mining apparatus; said system comprising a common pressure fluid feed line (P), a common pressure fluid return line (R) and manually operated control devices (11, 11') for selectively connecting the feed and return lines to respective first (15) and second (16) working chambers of associated props (10) of which a first working chamber (15) serves to extend and set the prop when connected to the pressure line; the improvement comprising setting valve means (18) with opposed first (24) and second (23) pressure-fluid operated control pistons, the setting valve means being settable with the first piston (24) into a first state where connection between the pressure line and said first working chamber (15) is blocked and settable with the second piston (23) into a second state where connection between the pressure line and said first working chamber is established independently of the operating position of the manually operated control devices (11, 11') the first control piston (24) of the setting valve means being connected to said first working chamber (15) and biased with spring force (35) into the first state; and control valve means (25) provided with a control piston (29) connected to said first working chamber (15) and biased with opposed spring force (31) to block the pressure line (P) from the second piston (23) of the setting valve means (18) unless a predetermined threshold pressure level prevails in said first working chamber (15) and to connect said second piston (23) of the setting valve means (18) to the pressure line (P) when said predetermined threshold pressure is exceeded in said first working chamber (15); whereby the control valve means (25) causes the setting valve means (18) to change from its first state to its second state to connect the first working chamber (15) to the pressure line (8) after an associated control device (11, 11') has connected the pressure line (P) to said first working chamber (15) and the threshold pressure level thereafter is exceeded so that connection between said first working chamber (15) and said pressure line (P) is maintained independent of the operating position of said associated control device, and whereby the setting valve means (18) thereafter reverts to its first state under the action of the first control piston (24) thereof once the pressure in the first working chamber (15) reaches a level in excess of the threshold level and signifying that prop setting has occurred.

2. A system according to claim 1, wherein the setting valve means takes the form of a block containing bores providing fluid passages and a slidable rod member provided with a frusto-conical region forming a valve element engageable on a seating, the first and second control pistons being formed at the opposite ends of the rod member and the spring force being provided by a compression spring which acts on the rod member to urge the valve element against its seating.

3. A system according to claim 2, wherein the block also contains a pressure-relief valve for permitting relief of the second control piston when the prop setting occurs and the first control piston changes the setting valve means to its first state.

4. A hydraulic control system for controlling pressure-fluid operated support props of mining apparatus; said system comprising:

(a) a main pressure fluid feed line (P) and a main pressure fluid return line (R);

(b) a plurality of manually-operable control devices (11, 11') for selectively connecting the feed (P) and return (R) lines to working chambers (15, 16) of the props (10) to effect extension and retraction thereof;

(c) a setting valve device (18) connected to the pressure line (P) and to a first working chamber (15) of one of the props (10), which chamber (15) is charged with fluid to effect extension of the prop (10), said valve device (18) being settable to a first state where connection is established via the device (18) between said working chamber (15) and the pressure line (P) independently of the manually set operating position of the associated control device (11, 11') or a second state where connection is broken via the device (18) between the pressure line (P) and said working chamber (15);

(d) a first control piston (23) of the valve device (18) for causing the valve device (18) to adopt said first state when connected to said pressure line (P);

(e) a further valve device (25) for connecting the first control piston (23) of the valve device (18) to the pressure line (P), to set said setting valve device (18) to said first state in which said working chamber (15) is connected to said pressure line (P) independently of the manually set operating position of the associated control device (11, 11'), in dependence on the operation of one of the control devices (11, 11') to establish connection between the pressure line (P) and said first working chamber (15) of said one prop (10) and the subsequent rise in the pressure in the first working chamber (23) to a threshold level signifying the onset of setting; and (f) a further control piston (24) of the setting valve device (18) connected to said first working chamber (15) and operable to cause the setting valve device (18) to adopt the second state subsequent to the adoption of the first state by the action of the first control piston (23) and when a predetermined setting pressure above the threshold pressure has been established in said first working chamber (15).

* * * * *